United States Patent [19]

Fleming

[11] 4,427,875

[45] Jan. 24, 1984

[54] ELECTRIC STEAM RADIATOR SPACE HEATING UNIT

[76] Inventor: Robert J. Fleming, 25 Shadowbrook La., Milford, Mass. 01757

[21] Appl. No.: 277,826

[22] Filed: Jun. 26, 1981

[51] Int. Cl.[3] ..... F24H 3/06; F22D 1/28; F24D 13/04

[52] U.S. Cl. ..... 219/341; 219/275; 219/306

[58] Field of Search ..... 219/341, 306, 275; 237/16–18

[56] References Cited

U.S. PATENT DOCUMENTS

| | | | |
|---|---|---|---|
| 1,064,849 | 6/1913 | Monnot | 237/16 |
| 1,447,952 | 3/1923 | Head | 219/341 X |
| 1,561,591 | 11/1925 | Bostedo | 219/341 |
| 2,041,116 | 5/1936 | De Kermor | 219/341 X |
| 2,276,407 | 3/1942 | Manzer | 219/341 X |
| 2,602,875 | 7/1952 | Behm | 237/16 X |
| 2,692,732 | 10/1954 | Lieberman | 237/17 |
| 2,841,685 | 7/1958 | Alexander | 219/341 |
| 3,179,788 | 4/1965 | Uhlig | 219/341 |
| 3,246,120 | 4/1966 | Bradenburg | 219/341 |
| 3,277,272 | 10/1966 | Rill et al. | 219/341 |
| 3,281,574 | 10/1966 | Heiman | 219/341 |
| 3,417,227 | 12/1968 | Barbier et al. | 219/365 |
| 3,640,456 | 2/1972 | Sturgis | 219/341 X |
| 3,927,299 | 12/1975 | Sturgis | 219/341 X |
| 4,105,894 | 8/1978 | Parks | 219/341 X |
| 4,297,563 | 10/1981 | Berry | 219/306 X |

FOREIGN PATENT DOCUMENTS

| | | | |
|---|---|---|---|
| 447766 | 4/1948 | Canada | 219/341 |
| 1003983 | 11/1951 | France | 219/341 |
| 232556 | 8/1944 | Switzerland | 219/341 |
| 113840 | 3/1918 | United Kingdom | 237/16 |

*Primary Examiner*—A. Bartis

*Attorney, Agent, or Firm*—Blodgett & Blodgett

[57] ABSTRACT

An electric steam radiator unit for heating residential and commercial spaces comprises an elongated vertical stack having a cylindrical central bore. The top of the stack communicates with one end of a generally horizontal heat exchange tube slightly downwardly inclined from the stack and having a plurality of heat radiating fins. A downwardly inclined condensate return tube connects the other end of the heat exchange tube to the bottom portion of the stack. The heat exchange tube, stack and condensate tube are joined in series to form a closed fluid circuit. An elongated cylindrical electric heating element disposed concentrically in the central bore extends the length of the stack to define a thin annular vaporization space. A small quantity of vaporizable liquid fills the lower part of the space and is converted to a vapor by action of the heating element. The vapor is superheated as it rises through the vaporization space to the heat exchange tube where it condenses to give up heat to the space being heated. The condensate is returned to the bottom of the stack through the condensate return tube for revaporization. A second heat exchange tube and condensate return tube may be connected to the stack diametrically opposite the first such tubes.

3 Claims, 2 Drawing Figures

ELECTRIC STEAM RADIATOR SPACE HEATING UNIT

BACKGROUND OF THE INVENTION

In the design of heating units for residential and commercial use, it has been common practice to provide a heat exchange unit, such as a radiator, containing liquid and with an electrical heater. The advantage of such units is that they can be placed easily in almost any location with a minimum amount of plumbing installation and can be simply plugged into an electrical convenience outlet. This is true, irrespective of whether the installation is to be permanent or temporary. The difficulty with such heating units, however, is that they are very inefficient. The heat available at the heat-exchange portion is the heat that can be absored by the metal in the radiator from the liquid inside. The metal receives this heat by conduction from the liquid, but only in an amount commenserate with lowering the temperature of the liquid as it flows through the radiator. Circulation takes place usually by the thermo-syphonic principle. With a given amount of heat capacity, therefore, the radiator must be quite large. These and other difficulties experienced with the prior art devices have been obviated in a novel manner by the present invention.

It is, therefore, an outstanding object of the invention to provide a heating unit with a large heating capacity despite its small size.

Another object of the invention is the provision of a heating unit which can be readily changed from one location to another and installed with no plumbing installation and with only a simple electrical connection.

A further object of the present invention is the provision of a heating unit making use of the heat of vaporization in its operation.

It is another object of the instant invention to provide a heating unit which is simple in construction, which is inexpensive to manufacture, and which is capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the invention consists of a heating unit having a short vertical stack with a generally horizontal heat-exchange tube extending from its upper end. An inclined condensate return tube joins the outer end of the heat-exchange tube to a lower portion of the stack. An electrical heating element is mounted in the lower portion of the stack to vaporize a liquid. The vapor thus generated flows upwardly through the stack into the heat-exchange tube where it condenses and then flows downwardly through the condensate return tube to the stack.

More specifically, the stack has a cylindrical bore, while the electrical heating element has an external cylindrical surface, the element being mounted concentrically in the stack to define a thin annular recess between them. The condensate return tube is connected to the stack above the electrical heating unit, so that condensate flows downwardly into the recess for vaporization.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figures 1, 2:
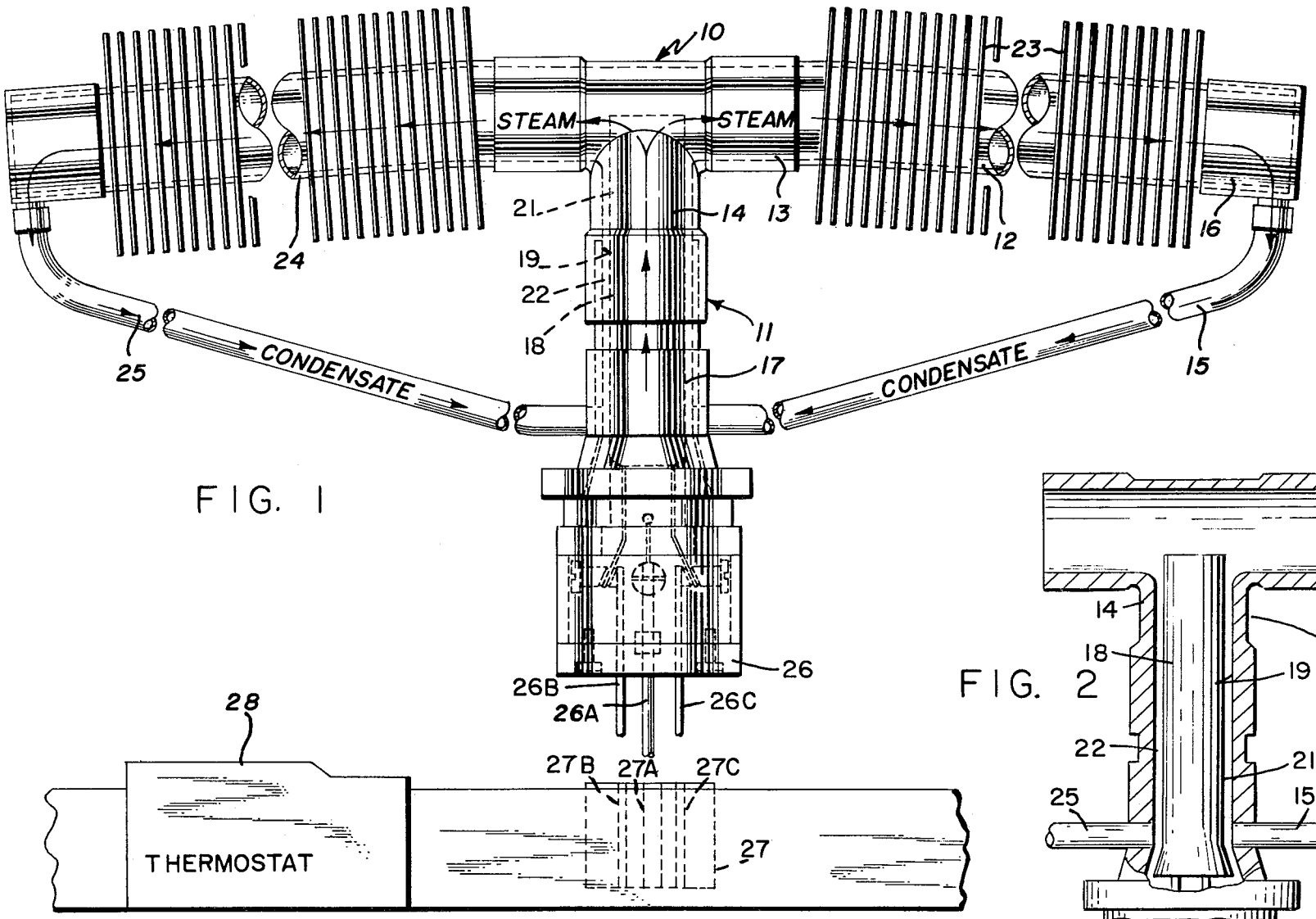
FIG. 1 is a front elevational view of a heating unit incorporating the principles of the present invention.
FIG. 2 is a vertical sectional view of a portion of the heating unit.

Referring to the drawing, the heating unit, indicated generally by the reference numeral 10, is shown as having a short vertical stack 11. The upper end 14 of the stack is connected to a one end 13 of a generally horizontal heat-exchange tube 12. An inclined condensate return tube 15 joins the other end 16 of the heat-exchange tube to a lower portion 17 of the stack 11. An electrical heating element 18 having two power terminals and a grounding connection is located in the stack to vaporize a liquid contained in the heating unit.

The stack 11 has a cylindrical bore 19, while the electrical heating element 18 has an outer cylindrical surface 21 which is concentric with the bore 19. A relatively thin passage or recess 22 is thus defined between the surface of the bore 19 and the cylindrical surface 21 of the electrical heating element. The heat-exchange tube 12 is provided with surface-extension fins 23, while in the preferred embodiment the condensation return tube 15 does not have such surface extension elements.

As is evident in the drawing, the heat-exchange tube 12 slopes slightly from the top of the stack, that is to say, from the end 13 to the other end 16. A second heat-exchange tube 24 and a condensate return tube 25 are connected to the stack in a plane approximately 180° from the plane of the first mentioned heat-exchange tube 12 and the condensate return tube 15. The second heat-exchange tube 24 is similar to the heat-exchange tube 12, but slopes slightly in the other direction. The condensate tube 25 is exactly the same as the condensate tube 15. The heating element 18 is connected by a grounded plug 26 passing through the lower end of the stack 11 to a source of electrical current, which source includes an automatic thermostat 28 for the regulation of the current. The plug 26 consists of a central grounding prong 26A and a pair of current-bearing prongs 26B and 26C. As is obvious in the drawing, the condensate tubes 15 and 25 join the stack 11 at a position located substantially above the bottom of the stack, thus leaving a lower recess or passage 22 in the stack. The heating element is located centrally in the recess with a thin annular space around it, so that fluid flowing down the condensate tube falls downwardly into the space for immediate conversion to vapor. The plug 26 is connected by binding posts and wires to the heating element 18. A socket 27 is provided in the source of electrical current and has sockets 27A, 27B, and 27C which receive the prongs 26A, 26B, and 26C, respectively, of the plug 26.

The operation and the advantages of the heating unit 10 will now be readily understood in view of the above description. With the operative fluid lying in the recess 22, with the heating element 18 connected through the plug 26 to the socket 27, and with the current regulated by the thermostat 28 indicates that the room is colder than the desired, preset value, electricity will flow through the plug 26 and through the heating element 18, to heat the fluid in the passage 22. Eventually, the fluid will vaporize and rise through the stack to the upper end 14. The vapor leaves the stack at the upper end and enters the heat-exchange tube 12 at the end 13. The steam will release heat by conduction into the tube 12 and the fins 23, so that air flowing over these fins will be heated and in turn will heat the room. The vapor, in engaging the wall of the heat-exchange tube, will condense, so that the heat given up will be the heat (1) contained in reducing the steam from its vapor temperature down to the condensation point, plus (2) the heat of vaporization which will be given up by its condensing on the walls of the tube. An added amount of heat (3) will be obtained from the resulting condensate as its temperature is further reduced in its passage through the heat-exchange tube. Because the heat-exchange tube is slightly inclined, the condensate will flow to the right (in the case of heat-exchange tube 12) and will flow downwardly through the condensate tube 15. The condensate will enter the stack again at a point above the recess 22 and will flow down into the passage for revaporization. Similarly, some of the vapor will pass to the left into the heat-exchange tube 24 and be condensed, so that the condensate flows down the condensate return tube 25 into the lower end of the stack for vaporization. It can be seen that the major amount of heat transmitted to the fins 23 of the heat-exchange tube is the heat of vaporization of the liquid, that is, the heat that is returned when converting the fluid from a vapor at its boiling point to a liquid at the same temperature. Because the heating element 18 is electrical and a resistance element, the energy conversion from electrical current in the heating element to convective heat retrieved by the air from the fins 23 is an operation which is almost 100% efficient. Any heat loss goes into the room and helps to heat the room.

It can be seen that the use of the present heating-unit allows very effective heating. It is portable and can be readily moved from one place to another; it only needs to be plugged into a source of electrical current to being operation because no plumbing is required. The unit is self-sufficient and only an electrical source need to be supplied. It is clear that a much smaller unit can be used to obtain a given amount of heat capacity. The heating unit can be made from commercially-available parts that are readily available on the market at low cost. Actually, only a small amount of liquid is used and this can be vaporized instantly to produce a hot vapor which, in turn, gives off its latent heat of vaporization to the heat-exchange tubes. The electrical source can be in the form of baseboard wiring which can be installed throughout a residence, so that the heating units can be moved from one place to another as seems to be desirable.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Heating unit, comprising:

(a) an elongated, substantially-vertical stack, (b) a generally elongated, horizontal heat exchange tube having heat exchange fins and having one end connected to an communicating with the upper end of said stack, (c) an inclined condensate tube joining the other end of said heat exchange tube to and in communication with a lower portion of said stack, said heat exchange tube sloping downwardly slightly from the top of said stack to the condensate tube, the heat exchange tube, condensate tube, and stack being joined in series to form a closed circuit for thermosyphonic action, (d) a quantity of vaporizable liquid in said stack and condensate tube, and (e) an electrical heating element located in said stack to vaporize the liquid, the vapor flowing upwardly through said stack into said heat exchange tube where it condenses and the resulting liquid flows downwardly through said condensate tube to said lower portion of said stack, said stack having a cylindrical bore, said heating element having a generally cylindrical surface and being mounted concentrically of the stack bore and extending the entire length of the stack, thus defining a thin annular space between the surface of the bore and the surface of the heating element, said liquid flowing into said space for conversion to vapor filling only the bottom portion of said annular space, whereby the vapors generated become superheated.

2. Heating unit as recited in claim 1, wherein a second heat-exchange tube and condensate tube are connected to the stack in a plane approximately 180° from the plane of the first-mentioned heat exchange tube and condensate tube and is similar in construction thereto.

3. Heating unit as recited in claim 1, wherein the heating element is connected through the lower end of the stack by a connection means to a source of electrical current, including an automatic thermostat for the regulation of the current.

* * * * *